US010247465B2

(12) United States Patent
Celik et al.

(10) Patent No.: US 10,247,465 B2
(45) Date of Patent: Apr. 2, 2019

(54) COOLING DEVICE COMPRISING A THAWING COMPARTMENT AND THE CONTROL METHOD THEREOF

(71) Applicant: ARCELIK ANONIM SIRKETI, Istanbul (TR)

(72) Inventors: Aydin Celik, Istanbul (TR); Feyzi Alper Soysal, Istanbul (TR); Aytac Timucin Oncul, Istanbul (TR)

(73) Assignee: ARCELIK ANONIM SIRKETI, Istanbul (TR)

( * ) Notice: Subject to any disclaimer, the term of this patent is extended or adjusted under 35 U.S.C. 154(b) by 30 days.

(21) Appl. No.: 15/515,962

(22) PCT Filed: Sep. 2, 2015

(86) PCT No.: PCT/EP2015/069990

§ 371 (c)(1),
(2) Date: Mar. 30, 2017

(87) PCT Pub. No.: WO2016/050434

PCT Pub. Date: Apr. 7, 2016

(65) Prior Publication Data

US 2017/0299251 A1 Oct. 19, 2017

(30) Foreign Application Priority Data

Oct. 2, 2014 (TR) ..... 2014/11677

(51) Int. Cl.

| | |
|---|---|
| ***F25D 21/06*** | (2006.01) |
| ***F25D 23/12*** | (2006.01) |
| ***F25D 21/00*** | (2006.01) |

(52) U.S. Cl.

CPC ..... *F25D 21/06* (2013.01); *F25D 21/002* (2013.01); *F25D 21/006* (2013.01); *F25D 23/12* (2013.01);

(Continued)

(58) Field of Classification Search

CPC .... F25D 21/002; F25D 21/006; F25D 21/008; F25D 21/02; F25D 21/06; F25D 21/08;

(Continued)

(56) References Cited

U.S. PATENT DOCUMENTS

| | | | |
|---|---|---|---|
| 3,945,217 | A | 3/1976 | Bashark |
| 4,002,199 | A | 1/1977 | Jacobs |

(Continued)

FOREIGN PATENT DOCUMENTS

| | | | |
|---|---|---|---|
| CN | 1967115 | A | 5/2007 |
| CN | 201193906 | Y | 2/2009 |

(Continued)

OTHER PUBLICATIONS

International search report and written opinion, dated Dec. 4, 2015, of corresponding International Application No. PCT/EP2015/069990; 8 pgs.

(Continued)

*Primary Examiner* — Marc E Norman

(74) *Attorney, Agent, or Firm* — Kilpatrick Townsend & Stockton LLP

(57) ABSTRACT

The present invention relates to a cooling device comprising a body; a thawing body that is disposed in the body, wherein the frozen foods are placed; a heater that heats the thawing compartment and a sensor that provides the measurement of the humidity of the ambient air of the thawing compartment.

7 Claims, 1 Drawing Sheet

(52) U.S. Cl.
CPC ..... *F25D 2317/04131* (2013.01); *F25D 2400/02* (2013.01); *F25D 2600/04* (2013.01)

(58) Field of Classification Search
CPC .. F25D 23/12; F25D 2400/02; F25D 2600/04; F25D 2700/02
See application file for complete search history.

(56) References Cited

U.S. PATENT DOCUMENTS

| | | | |
|---|---|---|---|
| 4,054,672 | A | 10/1977 | Inoue et al. |
| 4,326,390 | A | 4/1982 | Brooks |
| 4,385,075 | A | 5/1983 | Brooks |
| 4,395,887 | A | 8/1983 | Sweetman |
| 4,481,785 | A | 11/1984 | Tershak et al. |
| 4,528,821 | A | 7/1985 | Tershak et al. |
| 4,812,622 | A | 3/1989 | Takeda et al. |
| 4,909,040 | A | 3/1990 | Feltrin |
| 4,954,465 | A | 9/1990 | Kawashima et al. |
| 4,967,568 | A | 11/1990 | Harnden, Jr. et al. |
| 5,201,888 | A | 4/1993 | Beach, Jr. et al. |
| 5,326,578 | A | 7/1994 | Yun |
| 5,901,564 | A | 5/1999 | Comeau, II |
| 5,930,454 | A | 7/1999 | Cho |
| 6,165,526 | A | 12/2000 | Newman |
| 6,497,108 | B2 | 12/2002 | Collins et al. |
| 6,904,761 | B2 | 6/2005 | Rafalovich et al. |
| 7,748,228 | B2 | 7/2010 | Walker et al. |
| 9,528,745 | B2 | 12/2016 | Lukasse et al. |
| 2002/0011072 | A1 | 1/2002 | Hiraoka et al. |
| 2002/0039379 | A1 | 4/2002 | Ukai |
| 2003/0019222 | A1 | 1/2003 | Takahashi et al. |
| 2004/0139863 | A1 | 7/2004 | Boryca et al. |
| 2004/0244389 | A1 | 12/2004 | Denvir |
| 2004/0262300 | A1* | 12/2004 | Yu ..... A47J 37/085 219/685 |
| 2005/0217282 | A1 | 10/2005 | Strohm et al. |
| 2006/0289529 | A1 | 12/2006 | Ito et al. |
| 2007/0163291 | A1 | 7/2007 | Kim et al. |
| 2008/0168790 | A1 | 7/2008 | Hurlebaus et al. |
| 2008/0196427 | A1* | 8/2008 | Bianchi ..... F25D 17/042 62/176.6 |
| 2008/0282714 | A1 | 11/2008 | Cushman |
| 2008/0307818 | A1 | 12/2008 | Min et al. |
| 2010/0072870 | A1 | 3/2010 | Hwang |
| 2010/0218542 | A1 | 9/2010 | McCollough et al. |
| 2011/0088415 | A1 | 4/2011 | Lacey et al. |
| 2011/0219805 | A1 | 9/2011 | Youn et al. |
| 2012/0017630 | A1 | 1/2012 | Okabe et al. |
| 2012/0025104 | A1 | 2/2012 | Park et al. |
| 2012/0051030 | A1 | 3/2012 | Johnson |
| 2012/0085116 | A1 | 4/2012 | Maeng et al. |
| 2012/0266617 | A1 | 10/2012 | Lee et al. |
| 2013/0086928 | A1 | 4/2013 | Cho et al. |
| 2013/0104579 | A1 | 5/2013 | Zhou |
| 2013/0219925 | A1 | 8/2013 | Camatta et al. |
| 2014/0060104 | A1 | 3/2014 | Shur et al. |
| 2014/0305612 | A1 | 10/2014 | Celik et al. |
| 2014/0311726 | A1 | 10/2014 | Celik et al. |
| 2015/0069270 | A1 | 3/2015 | Shur et al. |
| 2015/0165079 | A1 | 6/2015 | Shur et al. |
| 2015/0354884 | A1 | 12/2015 | Met et al. |
| 2016/0245581 | A1* | 8/2016 | Gunduz ..... F25D 17/042 |

FOREIGN PATENT DOCUMENTS

| | | | |
|---|---|---|---|
| DE | 4318842 | A1 | 12/1994 |
| EP | 0360341 | A2 | 3/1990 |
| EP | 1674810 | A1 | 6/2006 |
| JP | S6414585 | A | 1/1989 |
| JP | H0445380 | A | 2/1992 |
| JP | H04165280 | A | 6/1992 |
| JP | H05141858 | A | 6/1993 |
| JP | H0634254 | A | 2/1994 |
| JP | H06137739 | A | 5/1994 |
| JP | H06257933 | A | 9/1994 |
| JP | H07019701 | A | 1/1995 |
| JP | H0755319 | A | 3/1995 |
| JP | H0894234 | A | 4/1996 |
| JP | H09224849 | A | 9/1997 |
| JP | H10332242 | A | 12/1998 |
| JP | 2000055529 | A | 2/2000 |
| JP | 2001147065 | A | 5/2001 |
| JP | 2001299307 | A | 10/2001 |
| JP | 2005351543 | A | 12/2005 |
| KR | 920002460 | B1 | 3/1992 |
| KR | 20060107040 | A | 10/2006 |
| WO | 0104553 | A2 | 1/2001 |
| WO | 2010076155 | A2 | 7/2010 |

OTHER PUBLICATIONS

Final Office Action dated Dec. 29, 2016, of U.S. Appl. No. 14/356,389; 18 pgs.
Final Office Action dated Jun. 2, 2017, of U.S. Appl. No. 14/654,825; 16 pgs.
International search report and written opinion, dated Jul. 11, 2014, of International Application No. PCT/EP2013/077646; 10 pgs.
International search report and written opinion, dated Jul. 4, 2013, of International Application No. PCT/EP2012/071754; 10 pgs.
International search report and written opinion, dated Jul. 4, 2013, of International Application No. PCT/EP2012/071761; 10 pgs.
Non-Final Office Action dated Feb. 10, 2017, of U.S. Appl. No. 14/654,825; 15 pgs.
Non-Final Office Action dated Feb. 24, 2017, of U.S. Appl. No. 14/356,383; 13 pgs.
Non-Final Office Action dated Jun. 2, 2016, of U.S. Appl. No. 14/356,389; 19 pgs.

* cited by examiner

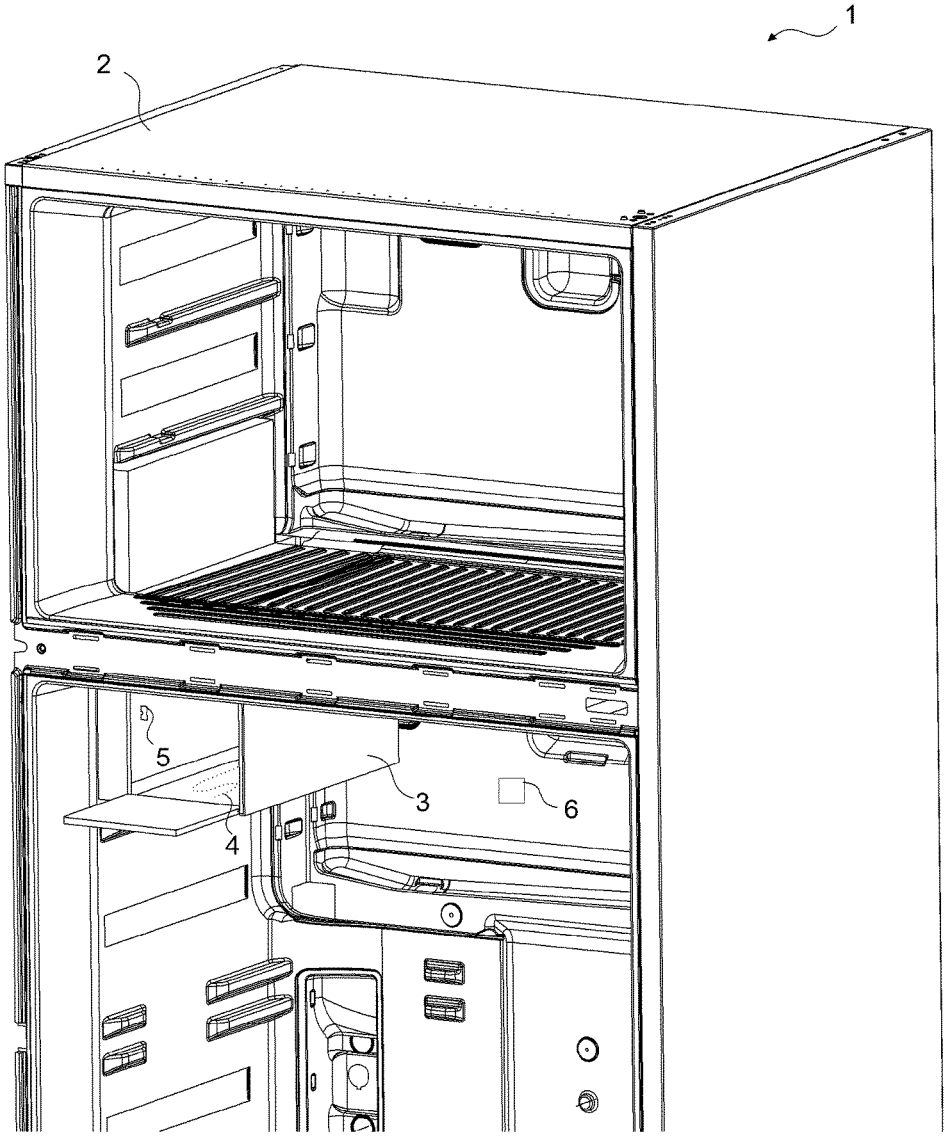
1
2
5
3
6
4

COOLING DEVICE COMPRISING A THAWING COMPARTMENT AND THE CONTROL METHOD THEREOF

RELATED APPLICATIONS

This application is a U.S. National Phase of International Application No. PCT/EP2015/069990, filed Sep. 2, 2015, claiming priority to Turkish Patent Application No. 2014/11677, filed Oct. 2, 2014, contents of which are hereby incorporated by reference in their entirety.

The present invention relates to a cooling device comprising a thawing compartment that enables the thawing of the frozen foods and to the control method thereof.

In cooling devices comprising thawing compartments, the thawing process is generally realized by heating the thawing compartment by means of a heater disposed at the base thereof. When the thawing/melting process is to be ended is determined according to the temperature of the food. Since the temperature of the food placed onto the heater in the thawing compartment is not homogeneous throughout the food surface, it becomes difficult to understand if the food is completely thawed or not. In thawing compartments wherein the surface of the food close to the heater is prevented from overheating and wherein the frozen food is placed in a suspended manner, the heat transmitted by convection thaws the outer surface of the food, but the central region of the food may remain frozen. Moreover, when the frozen food is overheated, the outer surface thereof starts to be boiled/roasted and this situation causes user dissatisfaction. Therefore, it is desired that the thawing process is effectively realized and terminated at the right time in the thawing compartments.

In the state of the art Japanese Patent Application No. JP2005351543, a cooling device is disclosed, that determines the thawing duration by defining the features of the frozen food such as weight, thickness, etc.

In the state of the art Japanese Patent Application No. JP2000055529, a cooling device is disclosed, wherein the humidity in the cooling device is kept under control in order to prevent the drying of the foods.

In the state of the art Japanese Patent Application No. JP07019701, a cooling device is disclosed, wherein the thawing efficiency is improved by removing the humidity in the thawing compartment.

The aim of the present invention is the realization of cooling device wherein the frozen foods are enabled to be thawed in a healthy and efficient manner.

The cooling device realized in order to attain the aim of the present invention, explicated in the first claim and the respective claims thereof comprises a sensor that measures the humidity level inside the thawing compartment and a control unit that calculates the humidity level change rate using the data received from the sensor, that compares the calculated value with the limit values prerecorded in its memory and that starts or ends the thawing process according to the result.

In the cooling device of the present invention, when foods are placed into the thawing compartment, the water vapor inside the thawing compartment condenses on the frozen food that is colder than the ambient temperature. With the condensation of the water vapor, the humidity level inside the thawing compartment starts to decrease. The control unit compares the humidity level change rate, in other words the humidity level decrease rate with the humidity level decrease rate limit value determined by the manufacturer and starts the thawing process upon deciding that a frozen food is placed into the thawing compartment. The humidity level that tends to decrease during the thawing process reaches the minimum level for the said thawing cycle after the melting of all the ice inside the frozen food. After this point, the melted ice that is in liquid phase on the food starts to evaporate and the humidity level inside the thawing compartment starts to increase. The control unit compares the humidity level change rate, in other words the humidity level increase rate with the humidity level increase rate lower limit value and the humidity level increase rate upper limit value determined by the manufacturer and recorded in the memory of the control unit and stops the thawing process. By stopping the thawing process at the right time depending on the humidity level change rate, the user is not required to check the thawing process.

In an embodiment of the present invention, the control unit provides the locking of the thawing compartment cover after the start of the thawing process and enables the cover to be kept locked until the thawing process is stopped. In this embodiment, heat losses that may occur due to the opening of the thawing compartment cover after the thawing process starts and thus the thawing process continuing longer that it is required are prevented.

In another embodiment of the present invention, the control unit decides that the thawing compartment cover is opened if the humidity level inside the thawing compartment rises quicker than the humidity level increase rate upper limit value determined by the manufacturer and recorded in the memory of the control unit during the thawing process and enables the user to be warned. When the thawing compartment cover is opened, the humid air in the outer environment causes the humidity level inside the thawing compartment to rise quickly. With this rapid increase in the humidity level, the control unit detects that the thawing compartment cover is opened.

In another embodiment of the present invention, the control unit enables the user to be warned that the thawing process has ended when the thawing process is completed. Thus, the user is not required to check the thawing compartment if the thawing process has ended or not and the user is informed at the end of the process.

In another embodiment of the present invention, the control unit enables the delivery of cool air into the thawing compartment if the thawing compartment cover is not opened for a time recorded in the memory of the control unit after the completion of the thawing process. By mean of this embodiment, if the user does not take the thawed food out of the thawing compartment, the current heat inside the thawing compartment is prevented from evaporating the water inside the food and thus from drying the food.

By means of the present invention, a cooling device is realized, that starts and/or stops the thawing compartment according to the humidity level of the thawing compartment. Thus, the thawing process is started and/or ended by the control unit automatically without requiring the intervention of the user. Since the termination of the thawing compartment depends on the melting of the entire ice on the food, by ending the thawing process at the right time, the user is prevented from being presented semi-thawed or over-thawed foods.

The cooling device realized in order to attain the aim of the present invention is illustrated in the attached figures, where:

FIG. 1—is the perspective view of the cooling device having a thawing compartment.

The elements illustrated in the figures are numbered as follows:

1. Cooling device
2. Body
3. Thawing compartment
4. Heater
5. Sensor
6. Control unit The following symbols are used in explicating the cooling device (1) of the present invention:

dH/dt: Humidity level change rate

V1: Humidity level decrease rate limit value determined by the manufacturer

Vbot: Humidity level increase rate lower limit value determined by the manufacturer Vtop: Humidity level increase rate upper limit value determined by the manufacturer The cooling device (1) comprises a body (2); a thawing body (3) that is disposed in the body (2), wherein the frozen foods are placed; a heater (4) that heats the thawing compartment (3) and a sensor (5) that provides the measurement of the humidity of the ambient air of the thawing compartment (3).

By heating the interior of the thawing compartment (3) by means of the heater (4), the frozen foods are thawed. The thawing process is realized at lower temperatures, for example at 10-15 C degrees for health reasons. By means of the thawing process realized at low temperatures, while the frozen foods are being thawed, the growth of bacteria is slowed (FIG. 1).

The cooling device (1) of the present invention comprises a control unit (6) that is disposed on the body (2), that calculates the humidity level change rate (dH/dt) in the thawing compartment (3) with the data received from the sensor (5), that enables the thawing process to be started if the calculated humidity level change rage (dH/dt) is above the humidity level decrease rate limit value (V1) determined by the manufacturer or that enables the thawing process to be ended after the thawing process is started if the calculated humidity level change rate (dH/dt) is between the humidity level increase rate lower limit value (Vbot) determined by the manufacturer and the humidity level increase rate upper limit value (Vtop) determined by the manufacturer. By means of this embodiment, the thawing process is started and ended independently from the physical properties of the frozen food, such as shape, weight, etc.

When frozen food is placed into the thawing compartment (3), condensation occurs on the frozen food that is colder than the ambient air in the thawing compartment (3). As the water vapor inside the thawing compartment (3) condenses on the frozen food, the humidity level in the air decreases. Since the humidity level inside the thawing process (3) is not the same for each cycle, the control unit (6) controls the humidity level change rate (dH/dt). In other words, the thawing process is controlled according to the change trends for different humidity levels for different conditions. If the humidity level change rate (dH/dt) is above the humidity level decrease rate limit value (V1) determined by the manufacturer as a result of experiments conducted under different conditions, in other words if the humidity level decreases faster than the limit value, the control unit (6) decides that a frozen food is placed into the thawing compartment (3) and starts the thawing process. The thawing process starts as the control unit (6) starts the heater (4). By means of this embodiment, the user is not required to press an activation button and the quality perception of the user is improved.

The heat transferred to the frozen food in the thawing process is used for melting the water that is in solid phase on the food. Since the heat dissipates from the surface towards the center thereof, the ice on the surface of the food melts before the ice at the center thereof. In this case, water is present on the frozen food in both solid and liquid phases. Since the latent heat of melting of ice is much lower than the latent heat of vaporization of water, the heat transferred to the frozen food is first used mostly for melting the ice. For this reason and moreover since the ambient temperature is low during the thawing process, the thawing process is realized almost isothermally, in other words without the melting of all the ice on the frozen food, the melted water does not start to vaporize. Since the thawing compartment (3) is a closed volume without any air intake/exit, the humidity level does not increase before the condensed water and the melted ice do not evaporate. For this reason, the humidity level inside the thawing compartment (3) does not increase before the frozen food is not entirely thawed. After the frozen food is fully thawed, the heat transferred to the frozen food by the heater (4) enables the water on the food to evaporate and increases the humidity level inside the thawing compartment (3). The control unit (6) compares the humidity level change rate (dH/dt) with the humidity level increase level lower limit value (Vbot) and the humidity level increase rate upper limit value (Vtop) determined by the manufacturer as a result of experiments conducted under different conditions and if the humidity level change rate (dH/dt) is between these limit values (Vbot, Vtop), decides that the ice on the frozen food has entirely melted and ends the thawing process. When the thawing process is ended, the control unit (6) deactivates the heater (4).

In an embodiment of the present invention, the control unit (6) enables the thawing compartment (3) cover to be kept locked after the start of the thawing process and until the thawing process is ended. By keeping the thawing compartment (3) cover locked during the thawing process, the heat losses are minimized and the thawing process is prevented from being prolonged.

In another embodiment of the present invention, the control unit (6) decides that the thawing compartment cover is opened if the humidity level change rate (dH/dt) inside the thawing compartment (3) exceeds the humidity level increase rate upper limit value (Vtop) determined by the manufacturer during the thawing process and enables the user to be informed that the thawing process has not ended. When the thawing compartment (3) cover is opened during the thawing process, the humid air in the outer environment causes the humidity level inside the thawing compartment (3) to rise quickly. The rate of the said increase is above the humidity level increase rate upper limit value (Vtop) determined by the manufacturer as a result of the experiments under different conditions. Thus, by monitoring the humidity level change rate (dH/dt) inside the thawing compartment (3), the control unit (6) detects if the thawing compartment (3) cover is opened or not.

In another embodiment of the present invention, the control unit (6) enables the user to be warned by audio or visual means that the thawing process has ended when the thawing process is completed. The control unit (6) conveys the information to the user that the food is thawed and ready for use when the thawing process is completed.

In another embodiment of the present invention, the control unit (6) enables the delivery of cool air into the thawing compartment (3) if the thawing compartment (3) cover is not opened for a time determined by the manufacturer after the completion of the thawing process. When the thawing process is completed and if the user does not open the thawing compartment (3) cover for a predetermined time, the control unit (6) provides the delivery of cool air into the thawing compartment so that the present heat inside the thawing compartment (3) does not dry/cook the thawed food. Thus, the thawed food does not lose any excess water.

In another embodiment of the present invention, the thawing compartment (3) comprises at least one fan (not shown in the figures) that enables the air therein to be propelled. By means of the fan, the air inside the thawing compartment (3) is circulated and the heat and the humidity are enabled to be homogeneously distributed.

In the cooling device (1) of the present invention, the thawing process is controlled by means of a control method executed by the control unit (6) and comprising the step of calculating the humidity level change rate (dH/dt) inside the thawing compartment (3).

In another embodiment of the present invention, in the control method executed by the control unit (6), the thawing process is controllably started by means of the steps of comparing the humidity level change rate (dH/dt) with the humidity level decrease rate limit value (V1) determined by the manufacturer and starting the thawing process upon deciding that a frozen food is placed into the thawing compartment (3) if the humidity level change rate (dH/dt) is above the humidity level decrease rate limit value (V1) determined by the manufacturer.

In another embodiment of the present invention, in the control method executed by the control unit (6), the thawing process is controllably ended by means of the steps of controlling if the humidity level change rate (dH/dt) is between the humidity level increase rate lower limit value (Vbot) determined by the manufacturer and the humidity level increase rate upper limit value (Vtop) determined by the manufacturer after the thawing process started and ending the thawing process upon deciding that the thawing process is completed if the humidity level change rate (dH/dt) is between the humidity level increase rate lower limit value (Vbot) determined by the manufacturer and the humidity level increase rate upper limit value (Vtop) determined by the manufacturer.

In the cooling device (1) of the present invention, the thawing process is started or ended independently from the weight and temperature of the food according to the humidity level change rate (dH/dt) inside the thawing compartment (3). Ending the thawing process at the right time, the control unit (6) prevents the food from semi-thawing or from being boiled/roasted by overheating.

The invention claimed is:

1. A cooling device comprising:

a body;

a thawing compartment that is disposed in the body, wherein frozen foods are placed in the thawing compartment;

a heater that heats the thawing compartment;

a sensor that measures humidity of ambient air of the thawing compartment; and a controller that is disposed on the body, wherein the controller is configured to calculate a humidity level change rate (dH/dt) in the thawing compartment with data received from the sensor, wherein the controller is configured to enable a thawing process to be started if the humidity level change rate (dH/dt) is above a humidity level decrease rate limit value (V1) determined by a manufacturer or wherein the controller is configured to enable the thawing process to be ended if the humidity level change rate (dH/dt) is between a humidity level increase rate lower limit value (Vbot) determined by the manufacturer and a humidity level increase rate upper limit value (Vtop) determined by the manufacturer.

2. The cooling device as in claim 1, wherein the controller is configured to enable a thawing compartment cover to be kept locked from a start of the thawing process until an end of the thawing process.

3. The cooling device as in claim 1, wherein the controller is configured to decide that a thawing compartment cover is opened if the humidity level change rate (dH/dt) inside the thawing compartment exceeds the humidity level increase rate upper limit value (Vtop) during the thawing process, and wherein the controller is configured to enable a user to be informed that the thawing process has not ended.

4. The cooling device as in claim 1, wherein the controller is configured to enable a user to be warned audibly or visually that the thawing process is completed at an end of the thawing process.

5. The cooling device as in claim 1, wherein the controller is configured to enable a delivery of cool air into the thawing compartment if a thawing compartment cover is not opened for a predetermined amount of time after a completion of the thawing process.

6. A control method for a cooling device comprising the steps of:

calculating a humidity level change rate (dH/dt) inside a thawing compartment of the cooling device;

comparing the humidity level change rate (dH/dt) with a humidity level decrease rate limit value (V1) determined by a manufacturer; and starting a thawing process upon deciding that a frozen food is placed into the thawing compartment because the humidity level change rate (dH/dt) is above the humidity level decrease rate limit value (V1) determined by the manufacturer.

7. A control method for a cooling device comprising the steps of:

calculating a humidity level change rate (dH/dt) inside a thawing compartment of the cooling device;

controlling if the humidity level change rate (dH/dt) is between a humidity level increase rate lower limit value (Vbot) determined by a manufacturer and a humidity level increase rate upper limit value (Vtop) determined by the manufacturer after a thawing process has started; and ending the thawing process upon deciding that the thawing process is completed because the humidity level change rate (dH/dt) is between the humidity level increase rate lower limit value (Vbot) determined by the manufacturer and the humidity level increase rate upper limit value (Vtop) determined by the manufacturer.

* * * * *